United States Patent [19]

Takagi

[11] 4,087,720

[45] May 2, 1978

[54] MULTI-BEAM, MULTI-APERTURE ION SOURCES OF THE BEAM-PLASMA TYPE

[75] Inventor: Toshinori Takagi, Nagaokakyo, Japan

[73] Assignee: Sharp Kabushiki Kaisha, Osaka, Japan

[21] Appl. No.: 729,825

[22] Filed: Oct. 5, 1976

[30] Foreign Application Priority Data

Oct. 8, 1975 Japan ..... 50/121906

[51] Int. Cl.[2] ..... H05H 1/00

[52] U.S. Cl. ..... 315/111.9; 313/359; 313/231.3

[58] Field of Search ..... 313/362, 360, 361, 363, 313/231.3, 359, 230; 250/423; 315/111.8, 111.9

[56] References Cited

U.S. PATENT DOCUMENTS

| | | | |
|---|---|---|---|
| 2,969,480 | 1/1961 | Klein | 313/362 X |
| 3,005,121 | 10/1961 | George | 313/360 |
| 3,846,668 | 11/1974 | Ehlers et al. | 313/230 X |

*Primary Examiner*—Palmer C. Demeo

*Attorney, Agent, or Firm*—Birch, Stewart, Kolasch & Birch

[57] ABSTRACT

A multi-beam, multi-aperture ion source of the beam-plasma type comprises three major regions: the first region where there is created a plurality of electron beams useful for the extraction and focusing of ions; the second region where a gaseous discharge is effected with the aid of the electron beams emerging from the first region, and high frequency oscillation or micro-wave oscillation is provided by utilization of instability due to electron beam-plasma interactions to thereby create high density ions by that heating energy; and the third region where the electron beams from the second region are collected through the use of a collector, and construction and applied voltage is adjusted to facilitate the high frequency oscillation. The numerous ions created within the second region are trapped into the form of finely focused beams by the well of negative potential which is defined by the plurality of the electron beams emerging from the first region. The resulting ion beams are extracted and combined in a direction opposite to the direction of the electron beams, thereby producing a single well-focused ion beam.

5 Claims, 8 Drawing Figures hydrogen gas
drift tube radius
of 0.55 cm

MULTI-BEAM, MULTI-APERTURE ION SOURCES OF THE BEAM-PLASMA TYPE

BACKGROUND OF THE INVENTION

The present invention relates generally to an ion source capable of providing an ion beam and especially a high-brightness, heavy current ion beam.

Generally speaking, within conventional ion sources which utilize electron bombardment ionization due to gaseous discharge, the correlation among normalized emittance E representative of the propriety of the path of ions, normalized brightness B and ion beam current I can be given below:

$$B = \frac{2I}{\pi^2 E^2} = C^2 \frac{e^2 N^2}{I} \frac{Te}{Ti} [A \cdot m^{-2} \cdot rad^{-2}]$$

wherein $C$ is the proportionality constant, $e$ is the charge of electrons, $N$ is the plasma density, $Te$ is the electron temperature and $Ti$ is the ion temperature.

Now assume that the following proportional relation is viewed between the electron temperature Te and the ion temperature T*i*.

$$\frac{Te}{Ti} = C' \frac{M}{m}$$

wherein $C'$ is the proportionality constant, $m$ is the mass of electrons and $M$ is the mass of ions.

If the plasma density N is rendered constant in dependence upon the type of ion sources, then the normalized brightness B and the normalized emittance E will be rewritten:

$$B \propto \frac{1}{I}$$

$$E \propto I$$

The dependencies of the brightness B and the emittance E as defined above are experimentally ascertained within ion sources of the high frequency discharge type, the P.I.G. type, the electron bombardment type, the duoplasmatron type, etc. However, if the plasma density N can be increased, then the different relation $B \propto I$ will exist because the plasma density N varies in proportion to the current I. The brightness B will be therefore increased with increase in the current I. As a matter of fact, heavy current can be permitted to flow without decreasing at least the brightness even though the brightness B can not be increased in proportion to the current due to any other parameters.

Accordingly, it is an object of the present invention to provide an ion source capable of producing a high brightness, heavy current ion beam, taking account of the above discussed aspects.

BRIEF DESCRIPTION OF THE DRAWINGS

A better understanding of the invention may be had from a consideration of the following detailed description taken in conjunction with the accompanying drawings in which.

DETAILED DESCRIPTION OF THE INVENTION

Figure 1:
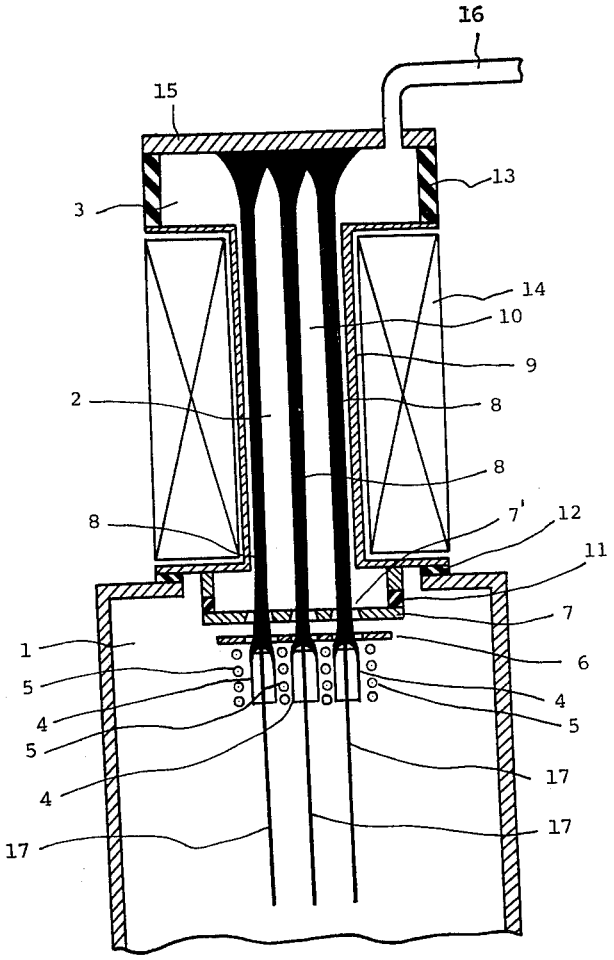
FIG. 1 is a cross sectional view of one preferred form of an ion source of the present invention.

Referring now to FIG. 1, there is illustrated an ion source constructed in accordance with the present invention which comprises three major regions 1, 2 and 3: the first region 1 is adapted such that a plurality of electron beams are generated to extract and focus a plurality of ions; the second region 2 is adapted such that gaseous discharge is effected by means of the electron beams from the first region 1 and high density ions are generated by means of microwave energy due to interactions between a plasma and the electron beams; and the third region 3 is adapted to collect the electron beams after being used and is provided with functions of fulfilling the requirement or microwave oscillation in the second region 2.

Within the first region 1, a plurality of cathode cylinders 4 of metal material are heated up to a high enough temperature for electrons to be emitted from the upper end of the cathode cylinders 4, through the use of a filament 5 disposed in spacing between the respective drum shaped cathodes 4 or bombardment of electrons emitted from that filament 5. The electrons emitted from the upper portion of the cathode cylinders 4 are entered into the second region 2 in the form of the multiple electron beams 8, in response to an electric field established by a focusing lens system comprising the cathode cylinders 4, a Wehnelt electrode 6 and a multi-aperture anode disc 7.

Within the second region 2 there is a drift cavity 10 which is surrounded by a metal cylinder 9 called drift tube. The drift cavity 10 has its upper end communicating with the third region 3 and its lower end separated from the first region 1 via the multi-aperture anode disc 7. The drift tube 9 serves also as a vacuum chamber enclosure and is electrically isolated via isolator cylinders 11, 12, 13 from other electrodes.

It is not necessarily required that the drift tube 9 serve as the vacuum cavity enclosure. In this instance, a special vacuum chamber enclosure of dielectric material or metal material may be provided about the drift tube 9.

Besides, a magnet 14 is provided outside of the drift tube 9 to form a magnetic field within the drift cavity 10 in its axial direction for the purpose of focusing the electron beams from the second region 2 and affording oscillation of the cyclotron frequency to the plasma. The result is that a high frequency electric field or microwave electric field is effectively established within the second region 2 by the beam-plasma interactions.

The upper portion of the drift tube 9, the isolator cylinder 13 and the collector electrode 15, in combination, form the third region 3. A material of metal in gaseous phase to be ionized is entered via a gas introduction aperture 16 formed in that region. On occasion, a small size metal vaporization crucible (not shown) is provided within the third region 3 such that the third region 3 and the drift tube 9 are filled with the vapor of the metal material for the ionization.

With such an arrangement, the gaseous material via the gas introduction aperture 16 or the metal vapor from the crucible is permitted to enter into the interior of the drift tube 9. The drift tube 9 is generally made of an electrically conducting material such as stainless steel or copper. Because the drift tube 9 has a narrow pipe shape and therefore extremely high stream resistance, it prevents gaseous neutral molecules in the third region 3 from escaping into the first region 1 or high vacuum region and keeps the drift cavity 10 at a gas pressure necessary for ionization. The drift tube 9 or the major component of the second region 2 operates as a kind of cylindrical wave guide tube to aid in creating the beam-plasma interactions in accordance with combinations of the plasma wave modes and the electron beams, the plasma wave modes being determined by a dispersion equation of the plasma in waveguide tubes. When the critical value is exceeded by the gas pressure in the drift cavity 10 and then a variety of conditions for example the beam current value of the electron beam 8 emerging from the first region 1, the acceleration energy, the shape of the drift tube 9 and the strength of the magnetic field in the drift tube 9, beam-plasma discharge takes place due to the beam-plasma interactions to thereby produce an extremely high density plasma efficiently.

The ionization phenomenon can be further promoted in the following manner: secondary electrons occurring when the electron beams 8 strike onto the collector electrode 15 are effectively introduced into the drift cavity 10 under the circumstance that the potential of the collector electrode 15 is held 100 through several hundred volts below that of the drift tube 9; alternatively, a second source of electrons is provided at the third region 3 to supply electrons to the drift tube 10 in the second region 2. As a consequence of this, the ion density in the drift cavity 10 is increased above the critical value necessary for initiating microwave oscillation due to beam-plasma interactions.

Thereafter, the high density ions thus obtained within the drift cavity 10 by virtue of the beam-plasma interactions are extracted in the opposite direction to the electron beams 8. At this time, negative space charge of the electron beams 8 emerging from the first region 1 neutralizes positive space charge. In other words, an electric field established by the focusing lens system including the multiple cathode cylinders 4, the Wehnelt electrode 6 and the multi-aperture anode disc 7 is an ion extraction electric field for the ions generated in the second region 2. Besides, the multi-aperture anode 7 at the boundary between the first region 1 and the second region 2 serves as an ion extraction electrode. The ions are therefore extracted via the respective apertures into the first region 1. The well-focused ion beams 17 are formed with the aid of the space charge neutralizing function of the electron beams to travel along the axial directions of the respective cathode cylinders 4. In addition to the formation of the multiple ion beams 17 described above, a single, heavy current ion beam may be formed by modifications in shape of the respective apertures 7' of the anode 7, the Wehnelt electrode 6 and the cathode cylinders 4. In this instance, the surface of the multi-aperture anode 7 is either concave or convex and its associated Wehnelt electrode 6 and cathode cylinders 4 are properly disposed, thereby arbitrarily controlling the shape of the ion beams 17 to be composed or combined.

Although the cathode 4 of FIG. 1 is of the so-called indirectly heated type which employs hollow cylinders made of electron emitting metal materials for example tungsten and tantalum, this may be substituted by the so-called directly heated type. In this case, an electron emitting metal wire is wound with a cylindrical, spiral configuration. Electrons are released upon direct application of heating current and simultaneously ions are permitted to pass through the axis of the spiral configuration. In case DC power is used for heating of the spirally shaped cathode, a magnetic field established by that DC power becomes advantageously contributive to focusing of electrons and ions.

Figure 2:
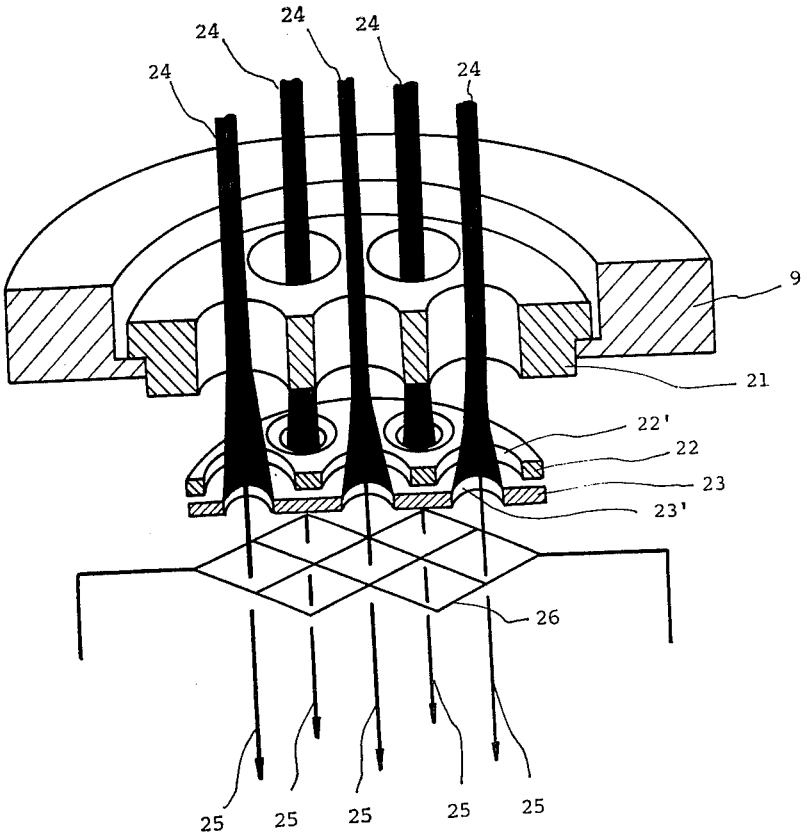
FIGS. 2 and 3 are perspective views of other preferred forms of the ion source of the present invention.

FIG. 2 illustrates an example of modifications in the first region 1. While in the preferred form of FIG. 1 the multi-aperture anode 7 at the boundary between the first region 1 and the second region 2 provides a shielding partition therebetween, the modification illustrated in FIG. 2 employs a special-purpose multi-aperture shield electrode 21 which is provided at the lower end of the drift tube 9 to form a definite prescribed boundary between the first region 1 and the second region 2. A multi-aperture anode disc 22 and a multi-aperture cathode disc 23 are disposed beneath the shield electrode 21, the axes of the respective apertures 22', 23' of these electrodes being kept in agreement with each other. The electrons are released from the peripheral portion around the apertures 23' of the cathode 23 and focused in the form of multiple electron beams 24. The resulting electron beams 24, thereafter, enter into the second region 2 and extract the ions from the second region 2 in the form of multiple ion beams 25. Although to avoid confusion in illustration a multi-aperture Wehnelt electrode plate to be disposed intermediate the anode disc 22 and the cathode disc 23 is omitted in FIG. 2, one or more electrode plates for constituting a focusing lens system may be disposed between the multi-aperture anode disc 22 and the multi-aperture cathode disc 23 for efficiently achieving release and focusing of the electron beams 24 around the apertures 23' of the cathode 23. In the given example a mesh filament 26 of rhombic shape is provided for the purpose of heating the multi-aperture cathode disc 23 in accordance with the electron bombardment method. Other modifications in the heating scheme and the shape of the multi-aperture cathode disc 23 are applicable.

Figure 3:
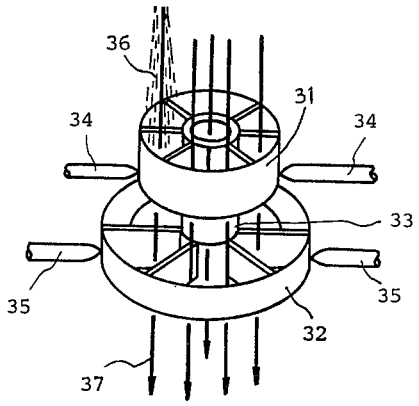

FIG. 3 shows another example of a cathode cylinder of the directly heated type.

Two coaxial cathode cylinders 31, 32 of wheel shaped cross section are coupled together with interposition of an intermediate cylinder 33 and adapted to receive DC or AC power transmitted from a power supply terminal 34 to a second power supply terminal 35 via the cathode cylinders 31, 33 and the interposed cylinder 33. Therefore, the cathode cylinders 31, 32 are held at a high temperature. Over the cathode cylinders 31, 32 there is provided a focusing electrode system which permits electrons to be released from the upper end of the cathode 31 and to be focused for each segment of the wheel shape cross sections. The electron beams 36 of which the number is equal to the number of the cross sectional segments are formed. Simultaneously, ion beams 37 are focused and extracted in the opposite directions to the electron beams 36 while through the respective electron beams 36.

Since the multi-aperture anode disc is employed in the foregoing description, the incident energy of the electron beams onto the drift cavity and the ion extraction energy are determined largely by applied voltage to the multi-aperture disc such that the multiple electron beams and the multiple ion beams assume substantially the same value. However, voltage is varied point-by-point under the circumstances that the multi-aperture disc is divided or the respective apertures are rendered independently of each other, then the respective beam energies may be adjusted correspondingly. This creates interactions between the ion beams and between the electron beams.

The first or principal characteristic of the present invention resides not only in that the electron beams 8 incident onto the second region 2 strike and ionize gaseous molecules and atoms remaining in the second region 2 but also in that high frequency oscillation (conventionally, microwave oscillation of 2–20 GHz) is caused to take place by the instability due to interaction of the plasma in the second region 2 and the incident electron beams 8 whereby AC power is absorbed into the plasma through the process of high frequency or microwave resonance and absorption to produce high density plasma. In other words, in response to the microwave electric field, electrons in the plasma are heated to carry energy enough to ionize neutral molecules. Subsequently, they strike and ionize the neutral molecules and enable the formation of the plasma by the ionization phenomenon called "beam-plasma discharge". The present system, therefore, may be termed an ion source of the self running oscillation, microwave heating type.

Figure 4:
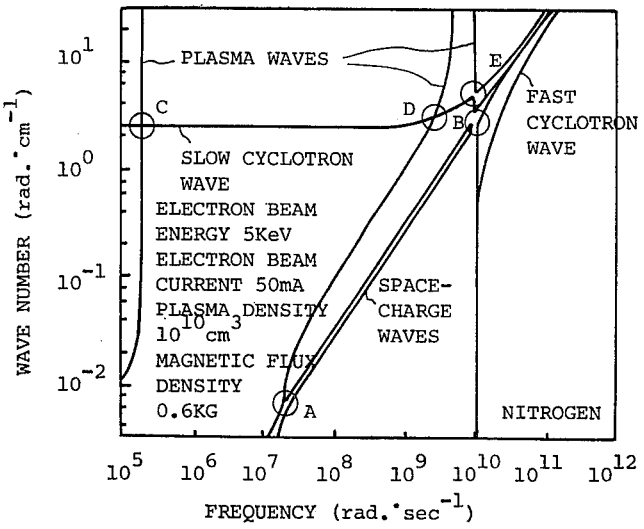
FIG. 4 is a dispersion diagram in the beam-plasma system of the above preferred forms of the present invention.

The beam-plasma interactions occurring within the second region 2 are shown in FIG. 4 which is one of dispersion diagrams calculated from small-signal analyses and plotted with wave number as ordinate $k$ and angular frequency $w$ as abscissa. It is well known that, if there is established an electric field in the longitudinal direction of a electron beam in response to space charge due to a disturbance caused by any factor, then the space charge wave will be permitted to occur by restoring force due to that electric field. In addition, the Lorentz Force determined by the axial magnetic flux and the lateral velocity will operate as the restoring force in the lateral direction of that electric field to thereby produce the cyclotron wave. The cyclotron wave stands in two electron wave modes, namely, the slow cyclotron wave and the fast cyclotron wave. Waves occuring in the beam-plasma system within the second region 2 are the space charge wave, the slow cyclotron wave, the fast cyclotron wave, the plasma wave, etc. These waves interact with one another within five active regions denoted as (A), (B), (C), (D), (E) in FIG. 4. (A), (C), (D) show convective instability regions whereas (B), (D) show absolute instability regions. The former indicate the space dependence of wave growing for convective instability whereas the latter indicate the time dependence of wave growing for absolute instability. The degree of the instability, that is, how difficult the formation of the microwave oscillation is accomplished, is indicated by evaluation of the imaginary parts of propagation constants and frequencies of these waves. Analysis demonstrates that absolute instability in the region (B) is the easiest of the interactions to effect. This is experimentally ascertained by measuring frequency of the microwave generated within the second region 2.

Figure 5:
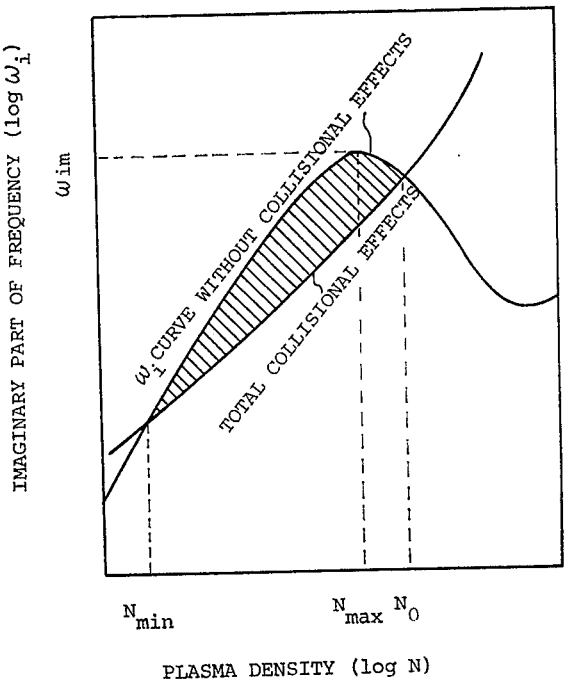
FIG. 5 is a characteristic diagram of the relations between the plasma density and the imaginary parts of frequency.

In FIG. 5, there is given qualitative analysis of the ionization breeding phenomenon due to the beam-plasma discharge, referring to the dependence of the quantity indicative of the instability namely the imaginary part of frequency, $\omega_i$, on the plasma density, N. In FIG. 5, N is plotted as the ordinate and $\omega_i$ is plotted as the abscissa. The $\omega_i$ curve without collisional effects has the maximum $\omega_{1m}$ at the maximum of the plasma density $N_{max}$. In cases where collisional effects are considered collision with neutral gas has the tendency to suppress the production of the microwave, while Coulomb's collision, high frequency electric field effects, etc., will cause the collision frequency to be suddenly increased with increasing plasma density N. Since the collision term tends to lower and shift $\omega_i$ in proportion to the collision frequency in the absolute instability regions such as (B), (E), the curve due to the collisional effects can be illustrated on the same figure where the $\omega_i$ curve without the collisional effects is indicated. The effective $\omega_i$, that is, the value indicative of oscillation growing in time relation, is estimated by the difference surrounded by these two curves.

Two intersecting points (F), (G) between the two curves, or the plasma densities $N_{min}$, $N_o$ at these points are defined as follows. In the plasma density lower than $N_{min}$, oscillations do not occur, and in the plasma density higher than $N_{min}$, oscillations grow up. Therefore, $N_{min}$ is the minimum plasma density for positive feedback, which increases the plasma density drastically. The plasma density then produced comes up to a steady state with the constant plasma density $N_o$. Since the curve has its maximum, the constant plasma density $N_o$ is approximately equal to the maximum $N_{max}$. In order to increase the steady plasma density $N_o$, which is dependent on the collision frequency, it is necessary to search for external conditions which increase $N_{max}$ according to the maximum of $\omega_i$. Moreover, it is necessary that $\omega_i$ be large enough to maintain oscillations. The threshold plasma density at which the oscillations start, $N_{min}$ is required. In other words, if the plasma density N due to the collision ionization by the electron beam 8 from the first region 1 is above $N_{min}$, microwave oscillations will occur which increase the plasma density N drastically. The plasma density then produced comes up to a steady state with the constant plasma density $N_o$ (nearly equal to $N_{max}$). To meet such requirement, the second electrons of high ionization efficiency from the third region 3 are introduced into the second region 2. As an alternative, the shape in the boundary between the second region 2 and the first or third region 1, 3 or gas pressure is appropriately chosen as a selected external condition.

Figure 6:
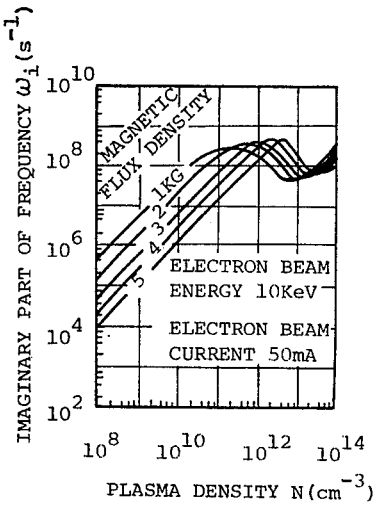
FIGS. 6(A), 6(B) and 6(C) are characteristic diagrams of the relations between the plasma density and the imaginary parts of frequency as a function of magnetic flux density (A), electron beam energy (B) and electron beam current (C).
Figure 6:
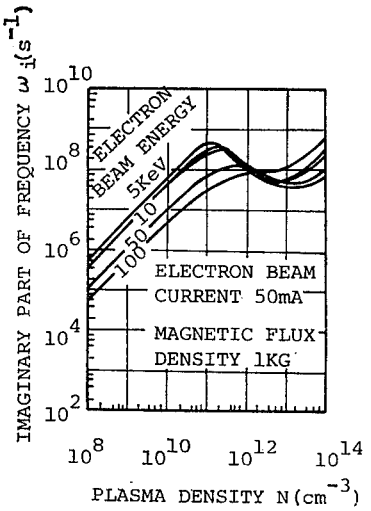
Figure 6:
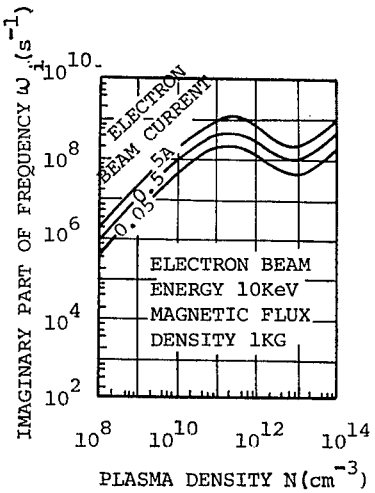

FIG. 6 illustrates the relation between the plasma density N and the imaginary part of frequency $\omega_i$ when varying the external conditions contributive to the beam-plasma interactions, for example, the magnetic field strength, the incident electron beam energy and the incident electron beam current.

The magnetic field which is established within the second region 2 by means of the magnetic field 14 provided around the second region 2, focuses the electron beams 8 from the first region 1 and determines the cyclotron frequency in the second region 2. As viewed from FIG. 6(A), when the magnetic field increases, $N_{max}$ increases whereas $\omega_1$ in the low plasma density N becomes smaller to raise a difficulty in initiating oscillations. Moreover, as obvious from FIG. 6(B), similar circumstances are viewed for variations in the beam voltage and hence the electron beam energy emitted from the first region 1. As shown in FIG. 6(C), for variations in the current the $\omega_i$ curve to the current to the one-third power. It is therefore expected that the high density plasma due to the beam-plasma discharge be obtainable by taking account of the variations in the above discussed parameters. For example, on the conditions of the electron beam energy of 20–50 KV, the electron beam current of 1–5 A and the magnetic flux density of 5–10 KG, the obtainable plasma density is about $10^{12}$–$10^{13}$ / $cm^3$.

In this manner, the first feature of the present invention is characterized in that the second region 2 is definitely separated from the first and the third regions 1, 3 so that these regions are electrically and mechanically controllable independently of each other in a manner to produce very effectively the beam-plasma discharge, thereby generating high density ions within the second region 2.

The second major feature of the present invention resides in the ion-beam extraction mechanism. The electron beams 8 are emitted from the first region 1 in order to create the beam-plasma discharge within the second region 2. Under the circumstances the ions generated in the second region 2 are trapped into the negative potential well established by the space charge of the electron beams 8. While the negative space charge of the electron beams neutralizes the space charge effects of the ions, the ions are extracted in the opposite direction to the advance of the electron beams 8 in response to the same electric field which accelerates and focuses the electron beams. Well-focused and stable ion beams can be obtained. In case it is desired to multiply the size of the ion surface by L and obtain the ion beam of the similar shape only by the same ion extraction voltage while remaining the ion extraction system of the optimum shape, it is required to multiply the plasma density N by $1/L^2$ in accordance with the proportionality theory. It is concluded that only the same ion current can be obtained. Therefore, to make up a heavy current ion source, it is preferred that the ion current as large as possible is extracted via the single-aperture electrode and a plurality of the ion extraction mechanisms of the optimum shape are arranged to constitute the multi-aperture ion beam extraction system.

The third major feature of the present invention resides in the fact that the multi-beam, multi-aperture extractor electrode assembly is constituted by combinations of the single-aperture electrodes each adapted to extract the ion current as large as possible whereby the multiple ion beams are composited into a single well-focused, heavy current ion beam. Employment of the multiple electron beams is to increase the electron beam current incident on the second region 2 and to accelerate the beam-plasma discharge. Thus, the high density plasma and in other words the high density, heavy current ion beam are obtainable.

While a certain representative embodiment and details have been shown for the purpose of illustrating the invention, it will be apparent to those skilled in this art that various changes and modifications may be made without departing from the spirit or scope of the invention.

I claim:

1. A multi-beam, multi-aperture ion source of the beam-plasma type which generates high density ions by utilization of microwave oscillation caused by interactions between electron beams and a plasma, said ion source comprising:

housing means defining first, second and third regions, said second region being in mutual communication with said first and third regions;

said first region including a focusing lens system including a plurality of cathodes, a Wehnelt cathode and a multi-apertured anode for generating and emitting a plurality of focused electron beams into said second region;

said second region being defined by an elongated cylindrical drift tube extending the length thereof, communicating at opposite ends with said first and third regions and containing an ionizable gaseous medium at a sufficient pressure for ionization to provide an ionized plasma, said second region further including means for inducing microwave energy oscillations therein to establish wave modes in said plasma which interact with said electron beams and said electron beams traversing the length of said drift tube in a pattern defining a well of negative potential trapping said ions in said second region into focussed ion beams propogating in the opposite direction to said electron beams; and said third region including a collector plate for receiving and collecting said electron beams from said second region and a source of ionizable material for supplying the latter to said second region;

said high density focussed ion beams being emitted from said second region through the said focussing lens system of said first region simultaneously with and in a direction opposite to the emission of said electron beams.

2. A multi-beam, multi-aperture ion source of the beam-plasma type as described in claim 1, wherein the second region further includes magnet means provided outside said drift tube to provide a magnetic field within the drift tube in the axial direction thereof for focusing said electron beams within said second region and said drift tube and imparting oscillation energy to said plasma.

3. A multi-beam, multi-aperture ion source of the beam-plasma type as defined in claim 1, wherein said ionizable material in said third region comprises metal in gaseous phase.

4. A multi-beam, multi-aperture ion source of the beam-plasma type as defined in claim 1, wherein said collector plate and said drift tube are maintained at a potential difference of between 100 and several hundred volts with said drift tube being maintained at the higher potential such that secondary electrons occurring when said electron beams strike said collector plate are effectively introduced into said drift tube.

5. A multi-beam, multi-aperture ion source of the beam-plasma type as described in claim 1, wherein said third region further includes a second source of electrons for enriching the electron supply in said drift tube.

* * * * *